United States Patent [19]

Catarious et al.

[11] 4,307,965

[45] Dec. 29, 1981

[54] MIXING APPARATUS

[75] Inventors: Joseph B. Catarious, Harleysville, Pa.; Carl A. Yacono, Trenton, N.J.; William W. McMahon, Hatboro, Pa.

[73] Assignee: Innovative Medical Systems Corp., Ivyland, Pa.

[21] Appl. No.: 154,627

[22] Filed: May 30, 1980

[51] Int. Cl.[3] ..... B01F 9/00

[52] U.S. Cl. ..... 366/208

[58] Field of Search ..... 366/208, 214, 217, 219, 366/233, 235, 605; 354/329; 74/67, 68; 51/164.1

[56] References Cited

U.S. PATENT DOCUMENTS

| | | | |
|---|---|---|---|
| 2,708,848 | 5/1955 | Hohenner | 74/67 X |
| 3,764,112 | 10/1973 | Jelley | 366/233 |
| 3,788,611 | 1/1974 | Barbini | 366/208 |
| 4,057,191 | 11/1977 | Ohno | 51/164.1 X |

FOREIGN PATENT DOCUMENTS

| | | | |
|---|---|---|---|
| 649838 | 9/1937 | Fed. Rep. of Germany | 366/235 |

*Primary Examiner*—Philip R. Coe
*Attorney, Agent, or Firm*—Robert J. Mooney

[57] ABSTRACT

A mixing device is disclosed for gently agitating the contents of one or more closed containers. The device includes a plurality of cylindrical rollers parallelly juxtaposed and adapted to rotate in an eccentric fashion about respective longitudinal axes that are parallel to each other and inclined to the respective cylindrical axes of the rollers. A drive bar coupling interconnects the rollers and a drive motor so that the rollers rotate in the same direction and at the same speed thereby imparting a simultaneous rocking and rolling motion to the containers when placed in supporting contact with adjacent rollers.

3 Claims, 7 Drawing Figures

MIXING APPARATUS

BACKGROUND OF THE INVENTION

The present invention relates to mixing devices and more particularly to an improved apparatus for gently agitating the contents of a plurality of closed cylindrical containers by simultaneously rotating and rocking the containers.

In the working environment of the scientific laboratory, researchers and technicians utilize a variety of devices to mix or blend the contents of test tubes and vials prior to conducting tests or experiments. Particularly in the field of hematology, such mixing devices are employed to blend blood samples in sealed containers to assure their homogeneity before a pathological or other medical examination. One such type of hematological mixing device involves the impartation of a gentle rocking or see-saw motion to the sealed containers while they are slowly rotated so that the samples are thoroughly mixed without frothing or breakdown of the blood cells. This type of device generally includes a plurality of cylindrical rollers mounted alongside each other having parallel cylindrical axes and positively interengaged to rotate in the same direction and at the same speed on rotational axes that are parallel to each other and angularly disposed to the respectively cylindrical axes so that the rollers rotate in an eccentric fashion.

While existing mixing devices of this type have been successful in properly agitating the contents of sealed cylindrical containers for laboratory tests and experimentation, such devices have experienced problems in the rotational driving and synchronous coupling of the rollers. Gear trains have been employed in such mixing devices to drive and couple the rollers, but have required precision alignments in their mounting to avoid binding and jamming during operation. Furthermore, such alignments have been time-consuming and resulted in costlier assemblies.

SUMMARY OF THE INVENTION

Accordingly, it is a general purpose and object of the present invention to provide an improved mixing apparatus for agitating the contents of containers.

Another object of the present invention is to provide a mixing device that thoroughly blends test samples in sealed test tubes and vials.

A further object of the present invention is to provide a mixer that is economical in construction and reliable in performance, not being given to jamming or binding in its operation.

Briefly, these and other objects of the present invention are accomplished by a mixing device for gently agitating the contents of one or more cylindrical containers. The device includes a plurality of cylindrical rollers parallely juxtaposed and adapted to rotate in an eccentric fashion about respective longitudinal axes that are parallel to each other but inclined to the respective cylindrical axes of the rollers. A drive bar coupling interconnects the rollers and a drive motor so that the rollers rotate in the same direction and at the same speed thereby imparting a simultaneous rocking and rolling motion to the containers when placed in supporting contact with adjacent rollers.

For a better understanding of these and other aspects of the present invention, reference may be made to the following detailed description taken in conjunction with the accompanying drawing in which like reference characters designate like parts throughout the figures thereof.

DESCRIPTION OF THE PREFERRED EMBODIMENT

Figure 1:
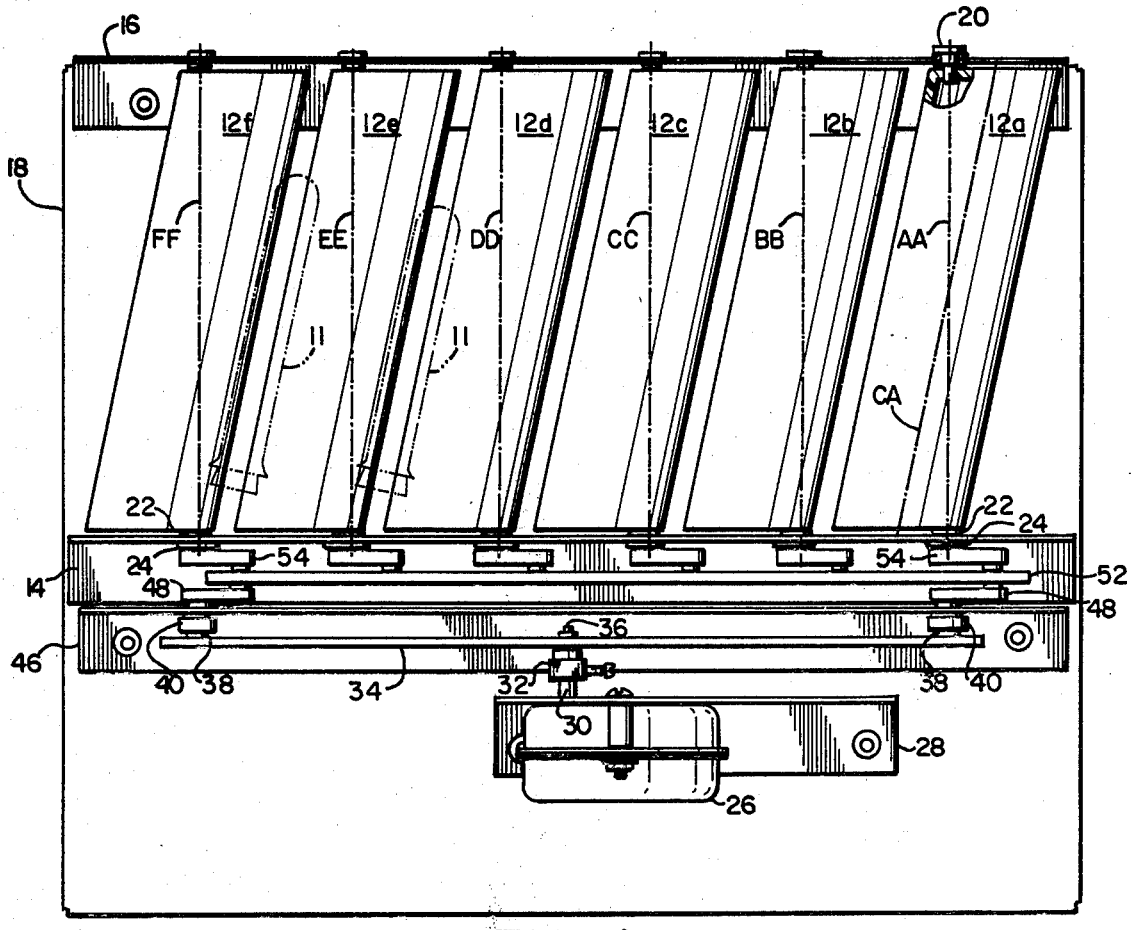
FIG. 1 is a top plan view of a mixing device according to the present invention.
Figure 2:
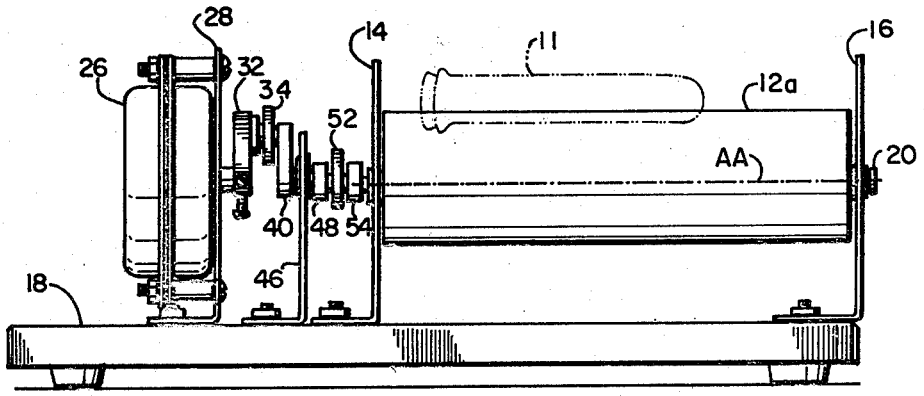
FIG. 2 is a side elevation view of the mixing device shown in FIG. 1.
Figure 3:
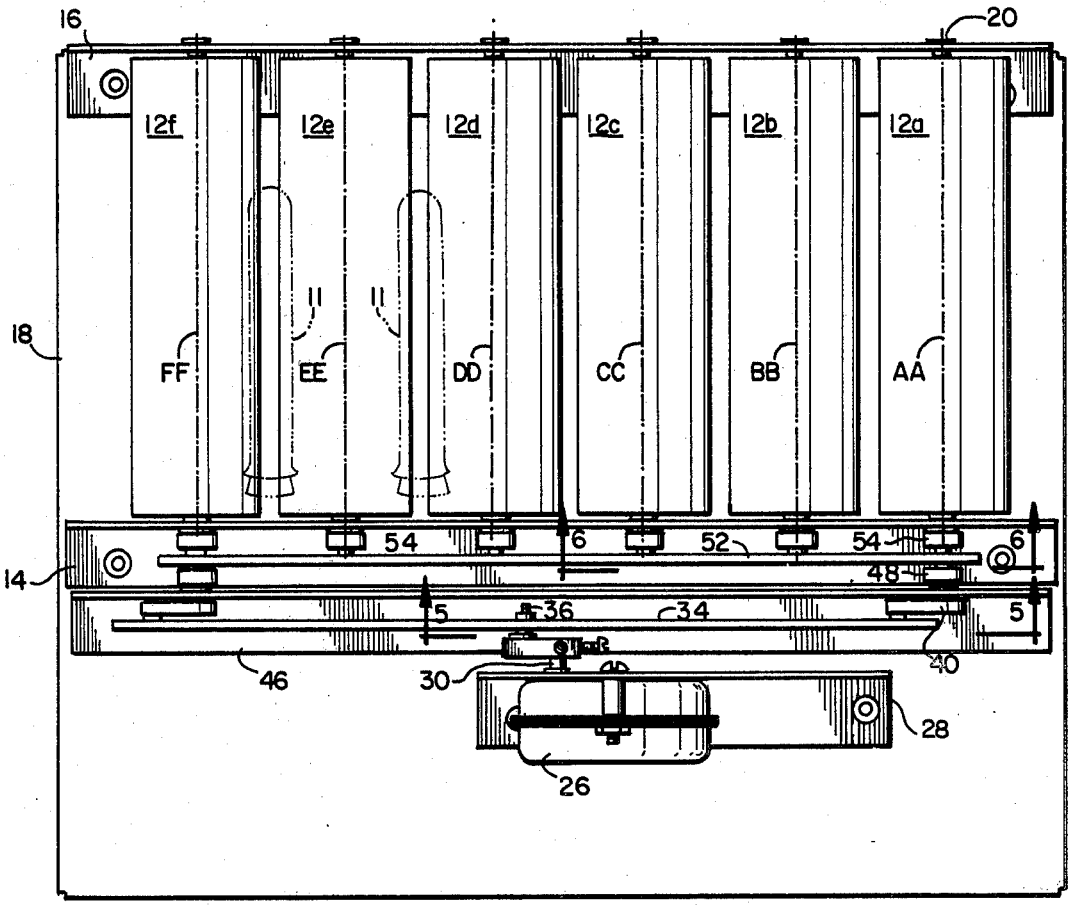
FIG. 3 is another top plan view of the mixing device showing it in a position 90° out of phase with that shown in FIG. 1.
Figure 4:
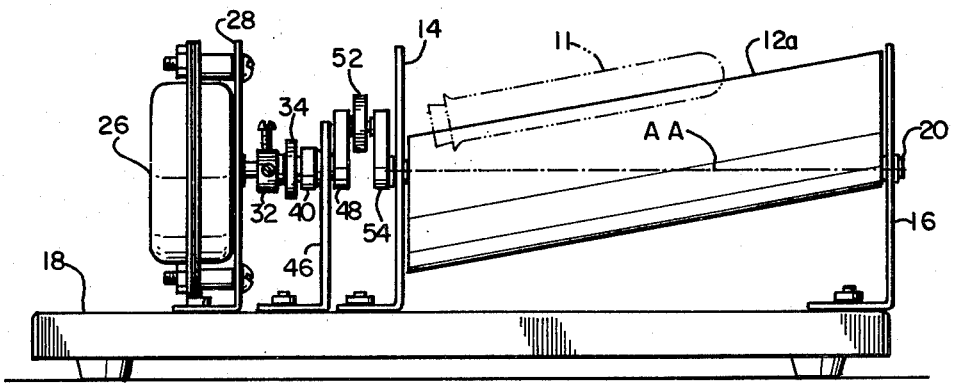
FIG. 4 is a side elevation view of the mixing device shown in FIG. 3.

Referring now to FIGS. 1 through 4, there is shown a mixing device according to the present invention as it operates to blend the contents of a pair of closed test tubes 11. The mixing device includes a series of cylindrical rollers 12*a*, 12*b*, 12*c*, 12*d*, 12*e*, and 12*f* rotatably mounted between a front support bracket 14 and a rear support bracket 16 above a base plate 18 to which each bracket is securely affixed. The rollers 12*a* through 12*f* are parallel to each other and juxtaposed so that the test tubes 11 or other sealed cylindrical containers, such as vials, may be supported between adjacent rollers. Rear bracket 16 is provided with a plurality of bearing couplers 20 equidistant from each other and identical in number to rollers 12*a* through 12*f*. Similar equidistant couplers 22 each provided with a bearing 24, better shown in FIG. 7, are rotatably fastened to the front support bracket 14 so that a series of longitudinal axes AA, BB, CC, DD, EE, and FF, all situated in a plane substantially parallel to baseplate 18, are established for rotation of the respective rollers.

Each of the cylindrical rollers 12*a*, 12*b*, 12*c*, 12*d*, 12*e* and 12*f* is similarly adapted at its ends to be fixed along the respective longitudinal axes AA, BB, CC, DD, EE, and FF between the couplers 20 and 22 on the rear and front brackets 16 and 14, respectively. Lying on the respective longitudinal axes AA, BB, CC, DD, EE and FF, the points of fixed engagement on either end of the rollers 12*a* through 12*f* are each eccentric with its associated end by an equal radial amount at each end, with each point of fixed engagement being angularly displaced relatively to one end of the roller by 180° relative to that at the opposite end. Thus, as shown for example in FIG. 1, the axis of rotation AA of roller 12*a* is inclined to its cylindrical axis CA so that the roller rotates in an eccentric fashion upon couplings 20 and 22.

An electric motor 26 for driving the mixing device is secured to the baseplate 18 via a mounting bracket 28 and is provided with input terminals (not shown) to receive a source of electrical power. The motor 26 is suitably geared internally to provide an output speed of typically about 15 R.P.M. to prevent undue movement or sliding of the test tubes 11 during mixing and is preferably of the bi-directional type that automatically reverses its rotational direction upon the encountering of an obstruction in the drive system. (It should be noted that the output speed provided by motor 26 may be varied dependent upon the requirements of any particular mixing application). An output shaft 30 extends from electric motor 26 and is secured to a motor crank 32 to provide circular motion to a first drive bar 34. A motor crank pin 36 is affixed to the motor crank 32 and extends therefrom to engage the first drive bar 34 near its center to couple the motor crank 32 to the drive bar 34. A pair of drive bar pins 38, better shown in FIG. 7, are located near either end of the first drive bar 34 and extend therethrough to engage one end of a pair of bell cranks 40 thereby coupling the drive bar 34 to the bell cranks 40 and providing rotational motion about the other end of the bell cranks 40.

Figure 5:
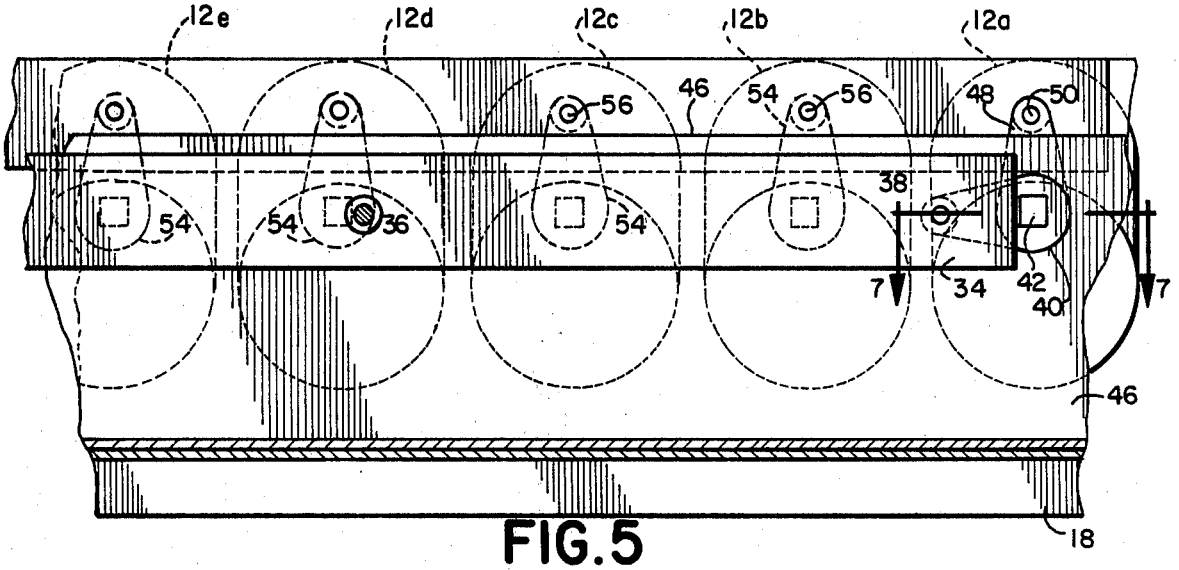
FIG. 5 is a sectional view of the mixing device taken along the line 5—5 in FIG. 3.
Figure 6:
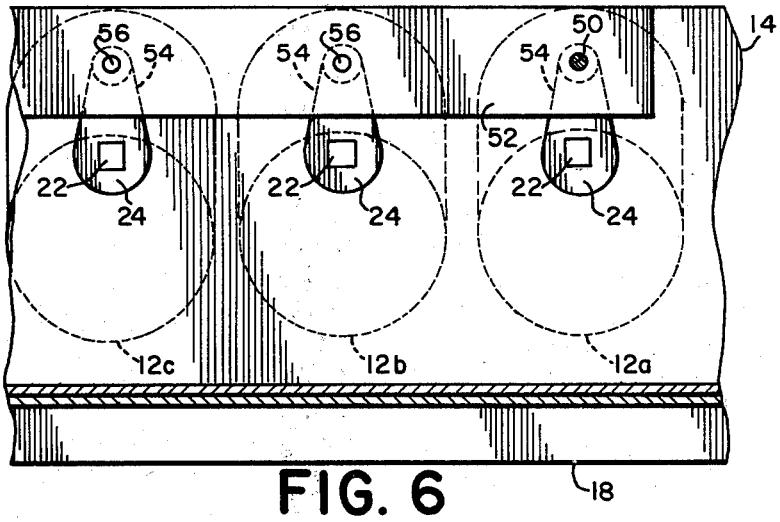
FIG. 6 is a sectional view taken along the line 6—6 of FIG. 3.
Figure 7:
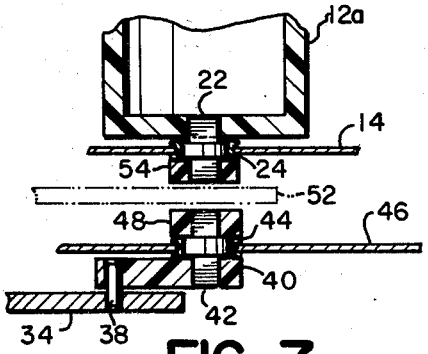
FIG. 7 is a sectional view of the device taken along the line 7—7 in FIG. 5.

Referring now additionally to FIGS. 5 through 7, each bell crank 40 is securely engaged by one end of a coupling member 42. Each coupling member 42 is supported on either side of baseplate 18 by a bracket 46 affixed thereto and set within a bearing 44 to insure rotational motion thereof. An intermediate bell crank 48, positioned 90° out of phase to each bell crank 40 on the opposite sides of the support bracket 46, is similarly engaged by the other end of coupling member 42 to insure transmission of the rotational motion thereto. It should be noted that the ends of coupling members 42 are preferably square-shaped to mate in corresponding square holes formed in bell cranks 40 and 48 so that the rotational motion transmitted therebetween is achieved without slippage.

A second drive bar 52 similar in length to the first drive bar 34 is coupled to each of the intermediate bell cranks 48 to produce circular motion of the second drive bar 90° out of phase with the motion of the first drive bar 34. A pair of long connecting pins 50 extend through and are secured within the second drive bar 52 near each end thereof to couple the drive bar to the intermediate bell cranks 48. It is preferred that each long connecting pin 50 be knurled along its middle portion to insure firm attachment within the second drive bar 52. A series of roller cranks 54, are identically oriented in phase with the intermediate bell cranks 48, with each roller crank being pivotally coupled at one end thereof to the second drive bar 52 along its length so that the roller cranks are turned synchronously by the motion of the second drive bar. The exterior pair of roller cranks 54 are coupled to the second drive bar 52 via the long connecting pins 50, while a series of equidistant short connecting pins 56 similarly engage the interior group of roller cranks 54. At the opposite ends thereof, each roller crank 54 is engaged in fixed relationship to respective rollers 12*a*, 12*b*, 12*c*, 12*d*, 12*e*, and 12*f* via the couplings 22 so that as the roller cranks are turned by the motion of the second drive bar 52, the rollers are rotated in their eccentric fashion about their respective rotational axes AA, BB, CC, DD, EE, and FF in the same sense of direction and at the same speed of rotation. Accordingly, rolling is imparted to the test tubes 11 by the synchronous rotation of the rollers 12 with which they are frictionally engaged, and the test tubes 11 experience a rocking motion in two dimensions by virtue of the inclined rotational axes about which the rollers 12 turn.

It should be noted that a cover (not shown) normally provided to enclose the motor 26 and drive bar mechanisms has been omitted from the drawings for the sake of clarity.

Therefore, it is apparent from the foregoing that the disclosed mixing device provides an improved apparatus for gently agitating the contents of cylindrical containers, such as closed test tubes or vials, by combining full axial rotation of the containers with a rocking motion in two dimensions which motions thoroughly blend the container contents. Furthermore, the disclosed mixing device is economical in construction and safe and reliable in performance.

Obviously, other embodiments and modifications of the present invention will readily come to those of ordinary skill in the art having the benefit of the teachings presented in the foregoing description and drawings. It is therefore understood that various changes in the details, materials, steps, and arrangement of parts, which have been described and illustrated to explain the nature of the invention, may be made by those skilled in the art within the principle and scope of the invention as expressed in the appended claims.

We claim:

1. An apparatus for mixing the contents of containers, comprising:

a support structure, a plurality of cylindrical rollers juxtaposed and rotatably mounted upon said support structure, said rollers having respective rotational axes parallel to each other and longitudinally inclined to respective cylindrical axes of said rollers so that said rollers rotate in an eccentric fashion;

a motor mounted upon said support structure and arranged to supply rotary drive along a motor axis; and a drive bar coupling means interconnecting said motor and said rollers, wherein said drive bar coupling means includes, a motor crank affixed along the motor axis; a first drive bar coupled to said motor crank and arranged for rotational motion in a first plane perpendicular to said motor axis;

phasing means connected to said first drive bar and arranged to produce a rotational motion ninety degrees out of phase with respect to the rotational motion of said first drive bar;

a second drive bar coupled to said phasing means and arranged for rotational motion in a second plane perpendicular to said motor axis; and a plurality of roller cranks each coupled to said second drive bar and to a respective one of said pluraity of cylindrical rollers;

whereby the containers are simultaneously rocked and rolled when placed in supporting contact with adjacent ones of said cylindrical rollers.

2. An apparatus for mixing the contents of containers, comprising:

a support structure, a plurality of cylindrical rollers juxtaposed and rotatably mounted upon said support structure, said rollers having respective rotational axes parallel to each other and longitudinally inclined to respective cylindrical axes of said rollers so that said rollers rotate in an eccentric fashion;

a motor mounted upon said support structure and supplying rotary drive along a motor axis;

a motor crank affixed along the motor axis;

a first drive bar coupled to said motor crank and arranged for rotational motion in a first plane perpendicular to said motor axis;

a plurality of intermediate cranks connected to said first drive bar and arranged to produce a rotational motion ninety degrees out of phase with respect to the rotational motion of said first drive bar;

a second drive bar coupled to said intermediate cranks and arranged for rotational motion in a second plane perpendicular to said motor axis; and a plurality of roller cranks each coupled to said second drive bar and to a respective one of said plurality of cylindrical rollers.

3. An apparatus according to claim 2 wherein said plurality of intermediate cranks is four arranged in pairs wherein each pair is rotatably coupled to said first and second drive bars and the cranks of each pair are fixedly secured athwart each other.

* * * * *